US007283762B2

(12) United States Patent
Roof

(10) Patent No.: US 7,283,762 B2
(45) Date of Patent: Oct. 16, 2007

(54) GLOSSING SYSTEM FOR USE IN A PRINTING ARCHITECTURE

(75) Inventor: Bryan J. Roof, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 166 days.

(21) Appl. No.: 11/000,258

(22) Filed: Nov. 30, 2004

(65) Prior Publication Data

US 2006/0115288 A1 Jun. 1, 2006

(51) Int. Cl.
*G03G 15/20* (2006.01)

(52) U.S. Cl. ..... 399/67; 399/69

(58) Field of Classification Search ..... 399/67, 399/69

See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,008,713 A 4/1991 Ozawa et al.
5,080,340 A 1/1992 Hacknauer et al.
5,095,342 A 3/1992 Farrell et al.
5,155,558 A 10/1992 Tannenbaum et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,497,218 A * 3/1996 Amico ..... 399/69
5,504,568 A 4/1996 Saraswat et al.
5,525,031 A 6/1996 Fox
5,557,367 A 9/1996 Yang et al.
5,568,246 A * 10/1996 Keller et al. ..... 399/382
5,570,172 A 10/1996 Acquaviva (Continued)

FOREIGN PATENT DOCUMENTS

JP 05333643 A 12/1993

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Anjan Deb
*Assistant Examiner*—Amy He
(74) *Attorney, Agent, or Firm*—Eugene O. Palazzo; Fay Sharpe LLP

(57) ABSTRACT

In a tightly integrated parallel printing architecture having at least a first print engine and a second print engine, the first print engine and a second print engine includes a first fuser system having a first fusing member for fusing marking particles on the substrate and second fuser system having a second fusing member for fusing marking particles on the substrate, including: a calibration system for maintaining uniform gloss characteristics between printed images generated by the first fusing system and the second fusing system, the calibration system including sensor for sensing a gloss value indicative of the gloss of the fused marking particles on the substrate.

14 Claims, 4 Drawing Sheets

U.S. PATENT DOCUMENTS 5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,995,721 A 11/1999 Rourke et al.
6,059,284 A 5/2000 Wolf et al.
6,097,500 A 8/2000 Fromherz
6,101,345 A 8/2000 Van Goethem et al.
6,125,248 A 9/2000 Moser
6,241,242 B1 6/2001 Munro
6,297,886 B1 10/2001 Cornell
6,337,958 B1 * 1/2002 Stanich et al. ..... 399/49
6,341,773 B1 1/2002 Aprato et al.
6,384,918 B1 5/2002 Hubble, III et al.
6,438,336 B1 8/2002 Bengtson
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,654,136 B2 11/2003 Shimada
6,819,906 B1 11/2004 Herrmann et al.
6,925,283 B1 8/2005 Mandel et al.
6,950,615 B2 * 9/2005 Jung et al. ..... 399/67
6,959,165 B2 10/2005 Mandel et al.
7,046,364 B2 * 5/2006 Schneider et al. ..... 356/446
2001/0021027 A1 9/2001 Ueno et al.
2002/0078012 A1 6/2002 Ryan et al.
2002/0103559 A1 8/2002 Gartstein
2003/0077095 A1 4/2003 Conrow
2004/0057741 A1 3/2004 Uehara et al.
2004/0085561 A1 5/2004 Fromherz
2004/0085562 A1 5/2004 Fromherz
2004/0088207 A1 5/2004 Fromherz
2004/0141764 A1 7/2004 Runkowske et al.
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

FOREIGN PATENT DOCUMENTS

JP 2003140415 A 5/2003
JP 2003156969 A 5/2003
JP 2004226484 A 8/2004
JP 2004226826 A 8/2004

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/,953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 25, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

GLOSSING SYSTEM FOR USE IN A PRINTING ARCHITECTURE

CROSS-REFERENCE TO RELATED APPLICATIONS

Reference is made to commonly-assigned copending U.S. patent application Ser. No. 10/953,953, filed Sep. 29, 2004, entitled "Customized Set Point Control For Output Stability", by David G. Anderson et al., copending U.S. Provisional Patent Application Ser. No. 60/631,918, filed concurrently herewith, entitled "Printing System With Multiple Operations for Final Appearance and Permanence", by David G. Anderson et al., copending U.S. Provisional Patent Application Ser. No. 60/631,921, filed concurrently herewith, entitled "Printing System With Multiple Operations for Final Appearance and Permanence", by David G. Anderson et al., copending U.S. patent application Ser. No. 11/000,158, filed concurrently herewith, entitled "Glossing System For Use In A Printing System", by Bryan J. Roof, copending U.S. Provisional Patent Application Ser. No. 60/631,651, filed concurrently herewith, entitled "Tightly Integrated Parallel Printing Architecture Making Use of Combined Color and Monochrome Engines", by David G. Anderson et al., copending U.S. Provisional Patent Application Ser. No. 60/631,656, filed concurrently herewith, entitled "Multi-Purpose Media Transport Having Integral Image Quality Sensing Capability", by Steven R. Moore, copending U.S. patent application Ser. No. 10/999,450, filed concurrently herewith, entitled "Addressable Fusing For An Integrated Printing System", by Robert M. Lofthus, et al.; and copending U.S. patent application Ser. No. 11/000,168, filed concurrently herewith, entitled "Addressable Fusing and Heating Methods and Apparatus", by Robert M. Lofthus et al., the disclosure(s) of which are incorporated herein.

BACKGROUND

This invention relates generally to a tightly integrated parallel printing architecture containing at least a first print engine and a second print engine and more particularly concerns calibration system for maintaining uniform gloss characteristics between printed images generated by the first print engine and the second print engine.

In the office equipment industry, different customers have different requirements as to their business relationship with the manufacturer of the equipment or other service provider. For various reasons, some customers may wish to own their equipment, such as copiers and printers, outright, and take full responsibility for maintaining and servicing the equipment. At the other extreme, some customers may wish to have a "hands off" approach to their equipment, wherein the equipment is leased, and the manufacturer or service provider takes the entire responsibility of keeping the equipment maintained. In such a "hands off" situation, the customer may not even want to know the details about when the equipment is being serviced, and further it is likely that the manufacturer or service provider will want to know fairly far in advance when maintenance is necessary for the equipment, so as to minimize "down time." Other business relationships between the "owning" and "leasing" extremes may be imagined, such as a customer owning the equipment but engaging the manufacturer or service provider to maintain the equipment on a renewable contract basis.

A common trend in the maintenance of office equipment, particularly copiers and printers, is to organize the machine on a modular basis, wherein certain distinct subsystems of a machine are bundled together into modules which can be readily removed from machines and replaced with new modules of the same type. A modular design facilitates a great flexibility in the business relationship with the customer. By providing subsystems in discrete modules, visits from a service representative can be made very short, since all the representative has to do is remove and replace a defective module. Actual repair of the module takes place away at the service provider's premises. Further, some customers may wish to have the ability to buy modules "off the shelf," such as from an office supply store. Indeed, it is possible that a customer may lease the machine and wish to buy a succession of modules as needed.

In order to facilitate a customer demand for even higher productivity and speed has been required of these image recording apparatuses. However, the respective systems have their own speed limits and if an attempt is made to provide higher speeds, numerous problems will occur and/or larger and more bulky apparatuses must be used to meet the higher speed demands. The larger and bulkier apparatuses, i.e. high speed printers, typically represent a very expensive and perhaps uneconomical apparatus. The expense of these apparatuses along with their inherent complexity can only be justified by the small percentage of extremely high volume printing customers. Therefore the utilization of plurality of print engine modules (IMEs) to provide higher printing speeds are highly desirable, such a system is disclosed in U.S. patent application Ser. No. 10/924,459 entitled "PARALLEL PRINTING ARCHITECTURE CONSISTING OF CONTAINERIZED IMAGE MARKING ENGINE MODULES".

In (tightly integrated parallel printing), machines have multiple fusers in a system so the generally low reliability of color fusers is a major concern for such systems. A second important consideration for these systems is gloss uniformity from fuser to fuser. Due to the tolerances in manufacturing, fuser conditions and components, deviation in gloss from marking engine to marking engine vary thereby providing a system to accomplish uniform gloss in a parallel printing system is an acute need.

SUMMARY

The present invention addresses the problems noted above by providing a tightly integrated parallel printing architecture having at least a first print engine and a second print engine, the first print engine and a second print engine includes a first fuser system having a first fusing member for fusing marking particles on the substrate and second fuser system having a second fusing member for fusing marking particles on the substrate, the tightly integrated parallel printing architecture having a sensor system, comprising: a calibration system for maintaining uniform gloss characteristics between printed images generated by the first fusing system and the second fusing system, said calibration system including sensor for sensing a gloss value indicative of the gloss of the fused marking particles on the substrate.

In one aspect, in a printing architecture having at least a first print engine and a second print engine, the first print engine and a second print engine including a first fuser system having a first fusing member for fusing marking particles on the substrate and second fuser system having a second fusing member for fusing marking particles on the substrate, a method for maintaining uniform gloss characteristics between printed images generated by the first fusing system and the second fusing system is provided. The method includes sensing a gloss value indicative of the gloss of the fused marking particles on the substrate and calibrating the first fusing system and the second fusing system so that the gloss of the fused marking particles on the substrates exiting the first fusing system and the second fusing system are within a predefined value,

DETAILED DESCRIPTION

Figure 1:
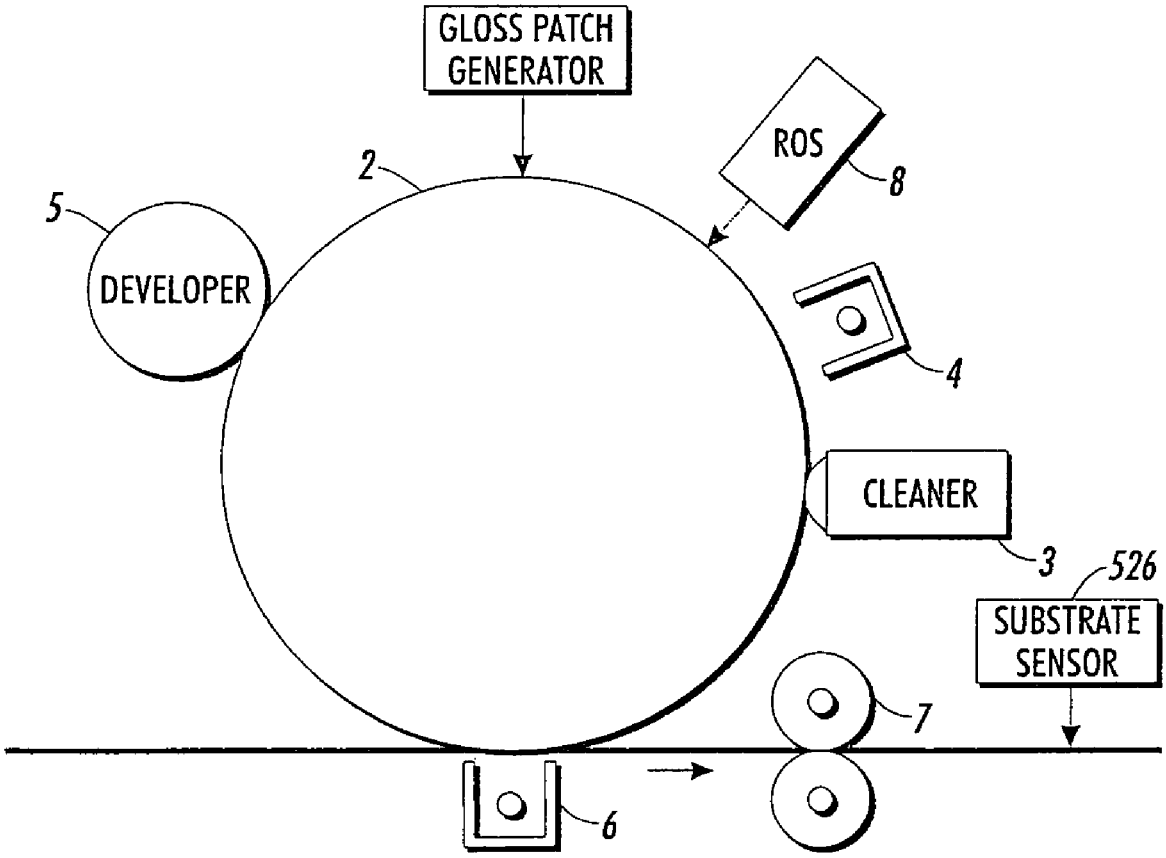
FIG. 1 is a simplified partially-elevational, partially-schematic view of an image marking engine in which two or more engine employed with the principles of the present invention.

FIG. 1 is a simplified partially-elevational, partially-schematic view of an electrophotographic printing apparatus in this case a combination digital copier/printer, in which many of the aspects of the present invention can be embodied. (As used in the claims herein, a "printing apparatus" or "image marking engine" (IME) can apply to any machine that outputs prints in whatever manner, such as a light-lens copier, digital printer, facsimile, or multifunction device, and can create images electrostatographically, by ink-jet, hot-melt, or by any other method.)

The one portions of hardware in the machine include a "xerographic module" or IME indicated as 1. As is familiar in the art of electrostatographic printing, there is contained within xerographic module 1 many of the essential hardware elements required to create desired images electrophotographically. The images are created on the surface of a rotating photoreceptor 2. Disposed at various points around the circumference of photoreceptor 2 are xerographic subsystems which include a cleaning device generally indicated as 3, a charging corotron 4 or equivalent device, a exposure station 8, a developer unit 5, a transfer corotron 6 and a fuser 7. Of course, in any particular embodiment of an electrophotographic printer, there may be variations on this general outline, such as additional corotrons, or cleaning devices, or, in the case of a color printer, multiple developer units. Xerographic subsystems are controlled by a CPU which adjusts various xerographic parameters. For example Developed Mass Area (DMA); transfer currents, fuser temperature to produce a high quality prints.

With particular reference to developer unit 5, as is familiar in the art, the unit 5 generally comprises a housing in which a supply of developer (which typically contain toner particles plus carrier particles) which can be supplied to an electrostatic latent image created on the surface of photoreceptor 14 or other charge receptor. Developer unit 5 may be made integral with or separable from xerographic module 1; and in a color-capable embodiment of the invention, there would be provided multiple developer units 5, each unit developing the photoreceptor 2 with a different primary-color toner.

Figure 2:
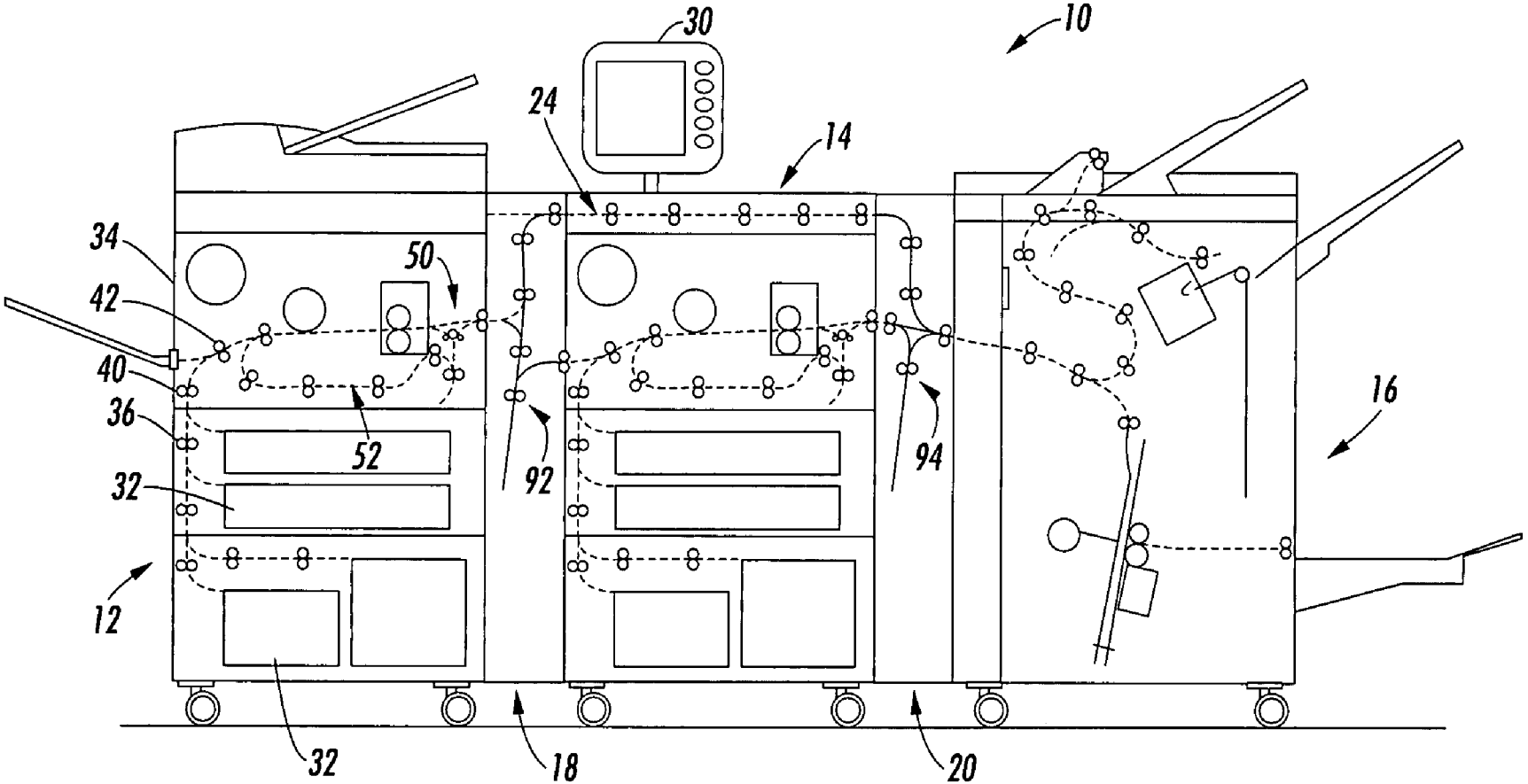
FIGS. 2 and 3 are sectional views showing an arrangement of image marking engines according to one possible embodiment that can be employed with the principles of the present invention.

FIG. 2 shows a schematic view of a printing system comprising a plurality of marking engines, as shown in FIG. 1, associated for tightly integrated parallel printing of documents within the system. Each marking engine can receive image data, which can include pixels, in the form of digital image signals for processing from the computer network by way of a suitable communication channel, such as a telephone line, computer cable, ISDN line, etc. Typically, computer networks include clients who generate jobs, wherein each job includes the image data in the form of a plurality of electronic pages and a set of processing instructions. In turn, each job is converted into a representation written in a page description language (PDL) such as PostScript RTM. containing the image data. Where the PDL of the incoming image data is different from the PDL used by the digital printing system, a suitable conversion unit converts the incoming PDL to the PDL used by the digital printing system. The suitable conversion unit may be located in an interface unit in the controller. Other remote sources of image data such as a floppy disk, hard disk, storage medium, scanner, etc. may be envisioned.

For on-site image input, an operator may use the scanner to scan documents, which provides digital image data including pixels to the interface unit. Whether digital image data is received from scanner or computer network, the interface unit processes the digital image data in the form required to carry out each programmed job. The interface unit is preferably part of the digital printing system. However, the computer network or the scanner may share the function of converting the digital image data into a form, which can be unutilized by the digital printing system 10.

More particularly, printing system 10 is illustrated as including primary elements comprising a first marking engine 12, a second marking engine 14, a finisher assembly 16. Connecting these three elements are three transport assemblies 18, 24 and 20. The document outputs of the first marking engine 12 can be directed either up and over the second marking engine 14 through horizontal by-pass path 24 and then to the finisher 16. Alternatively, where a document is to be duplex printed, the first vertical transport 18 can transport a document to the second marking engine 14 for duplex printing. The details of practicing parallel simplex printing and duplex printing through tandemly arranged marking engines are known and can be generally appreciated with reference to the foregoing cited U.S. Pat. No. 5,568,246. In order to maximize marking paper handling reliability and to simplify system jam clearance, the marking engines are often run in a simplex mode. The sheets exit the marking engine image-side up so they must be inverted before compiling in the finisher 16. Control station 30 allows an operator to selectively control the details of a desired print job.

The marking engines 12, 14 shown in FIG. 2 are conventional in this general illustration and include a plurality of document feeder trays 32 for holding different sizes of documents that can receive print markings by the marking engine portion 34. Each document feeder tray may include document substrates having different attributes such as roughness, coats, weights and etc. The documents are transported to the marking engine portion along a highway path 36 which is common to a plurality of the trays 32. It is to be appreciated that any document or media transport path within any of the alternative embodiments outside of the image transfer zone of the marking engine should be considered a high speed highway of document transports. By "highway" path portions is meant those document transport paths where the document is transported at a relatively high speed. For example, in a parallel printing system the sheets are transported through the marking engines at an optimum velocity, but in order to merge the sheets from two or more marking engines together without overlapping them, the sheets must be accelerated up to a higher velocity. A similar situation occurs when providing a stream of blank media to two or more marking engines. The velocity of the highways is therefore generally higher than the velocity used in the marking engines. A plurality of nip drive rollers associated with process direction drive motors (not shown), position sensors (not shown) and their associated control assemblies (belts, guide rods, frames, etc., also not shown) cause the transport of documents through the system at the selected highway speed. Documents printed by the marking engine generally must be transported at a slower speed than the highway through the image transfer zone of the marking engine. The image transfer zone can be considered to be that portion of the marking engine 34 in which some portion of the sheet is in the process of having an image transferred to it and in some marking engines, fused. Each marking engine 12, 14 is shown to include an inverter assembly 50 conventionally known as useful for duplex printing of a document by the same engine. More particularly, after one side of a document is printed, it is transported to the inverter assembly 50 where it is inverted and then communicated back to the image transfer zone by duplex path 52.

Figure 3:
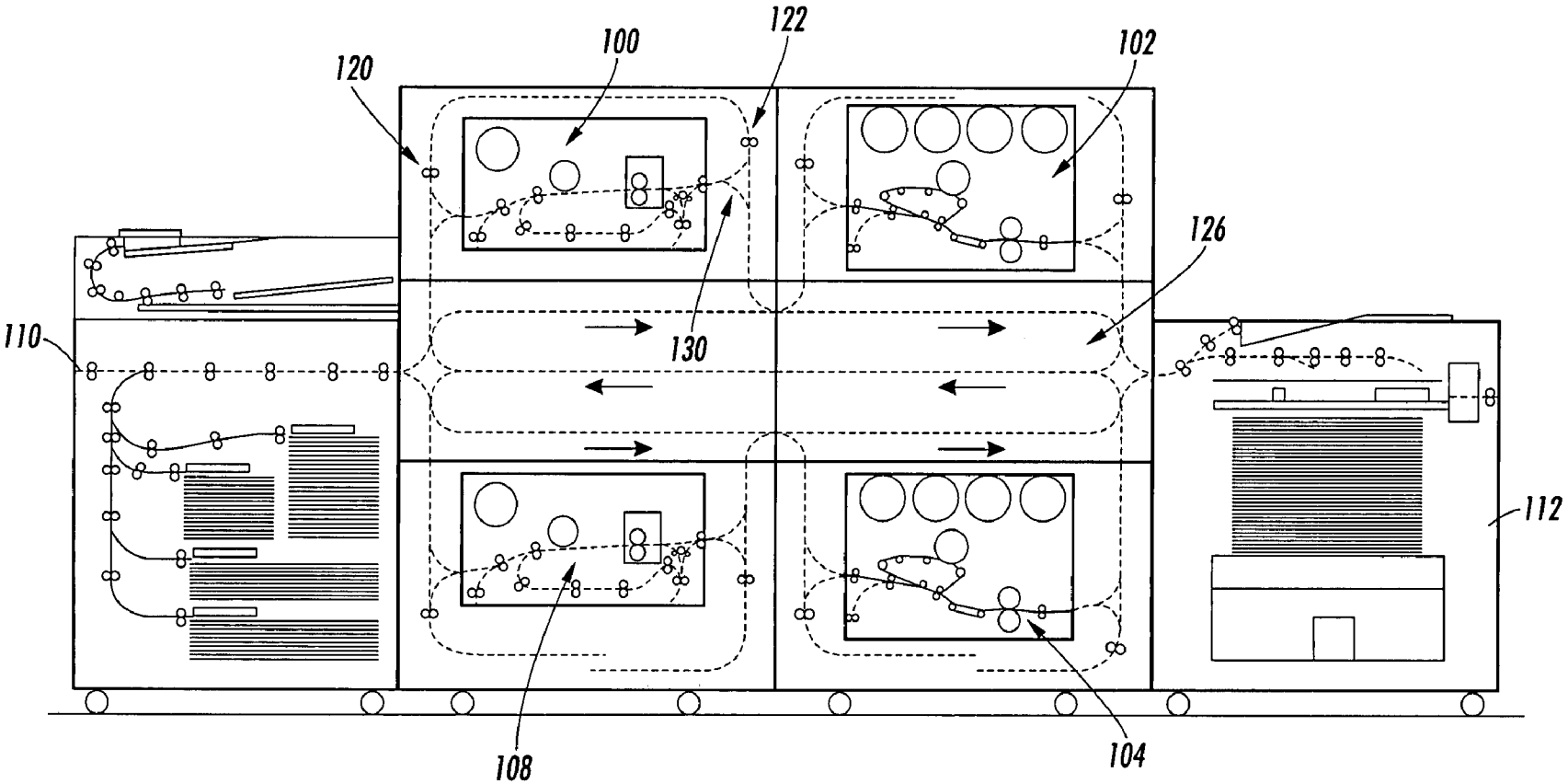

With reference to FIG. 3, another tightly integrated parallel printing system architecture is illustrated, particularly showing alternative dispositions of inverter assemblies as velocity buffers between high speed highways and the marking engines. In this system, the inverters could also optionally include registration capability. In the architecture of FIG. 3, four marking engines 100, 102, 104, and 108 are shown interposed between a feeder module 110 and a finishing module 112. The marking engines can be different types of marking engines, i.e., black only, custom color or color, for high speed parallel printing of documents being transported through the system. Each marking engine has a first inverter assembly 120 adjacent an entrance to the marking engine 100 and an exit inverter assembly 122 adjacent an exit of the marking engine. As noted above, as the document is being processed for image transfer through the marking engine 100, the document is transported at a relatively slower speed, herein referred to as engine marking speed. However, when outside of the marking engine 100, the document can be transported through the interconnecting high speed highways at a relatively higher speed. In inverter assembly 120 a document exiting the highways 126 at a highway speed can be slowed down before entering marking engine 100 by decoupling the document at the inverter from the highways 126 and by receiving the document at one speed into the inverter assembly, adjusting the reversing process direction motor speed to the slower marking engine speed and then transporting the document at slower speed to the marking engine 100. Additionally, if a document has been printed in marking engine 100, it exits the marking engine at the marking engine speed and can be received in the exit inverter assembly 122 at the marking engine speed, decoupled from the marking engine and transported for re-entering the high speed highway at the highway speed. Alternatively, it is within the scope of the subject embodiments to provide additional paper paths 130 to bypass the input or exit inverter assemblies. Additionally, as noted above, any one of the inverter assemblies shown in any of the architectures could also be used to register the document in skew or in a lateral direction.

Figure 4:
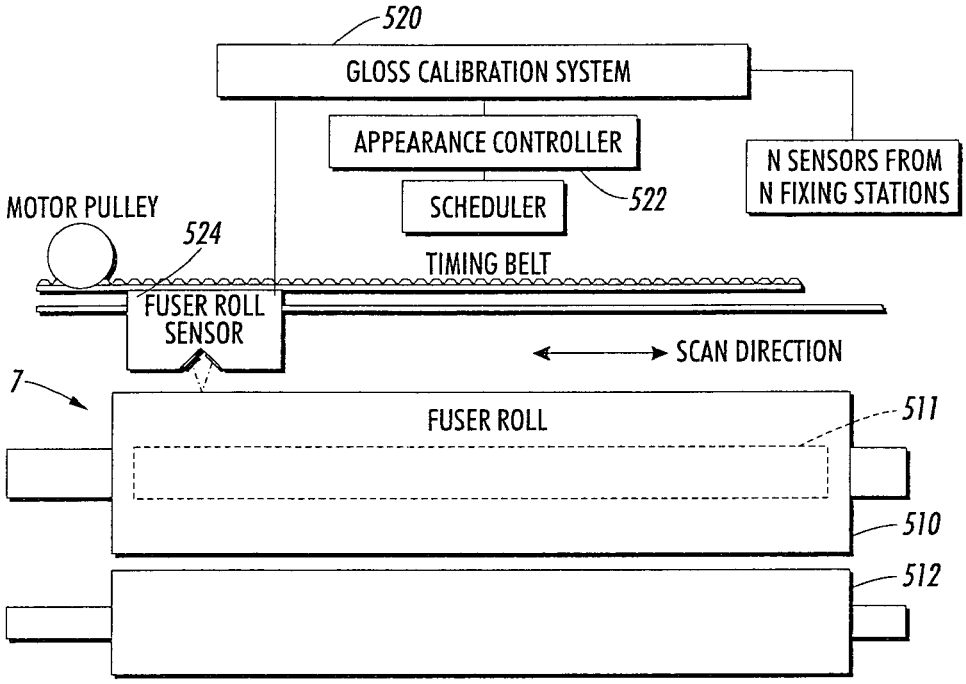
FIG. 4 illustrates a schematic of an appearance employed with the present invention.

Now referring to FIG. 4, each IME includes a fuser system 7 which includes a fusing member 510, that contacts the topmost layer of marking particles on the substrate and a pressure roll 512. A heating element 511 is disposed with the fusing member 510. A gloss calibration system 520 is provided for monitoring gloss levels of each fuser system so that gloss levels from each fuser system are within a predefined target value thereby maintaining uniform gloss characteristics between printed images generated by all IMEs. The gloss calibration system includes an appearance controller 522 for controlling the gloss output levels of each fuser system; and appearance sensors, such as a fuser gloss sensor 524 and a substrate gloss sensor 526 (FIG. 1), for detecting gloss levels of printed images generated by all IMEs. The appearance sensor 524, 526 communicates with the appearance controller 522 that generates a control signal if detected gloss levels are beyond the predefined target value. These sensors provide real-time measurements to the gloss calibration system 520, which makes adjustments to the various fuser systems 7 in order to keep final appearance within a predefined target value.

Referring back to FIG. 1, the substrate sensors 526 monitor the gloss of the substrates exiting the fuser system and feedback the gloss value back to the gloss calibration system 520. This data is used to adjust the parameters of the fuser system 7 such as fuser temperature, fuser speed, and nip pressure between the fusing member 510 and pressure roll 512. Preferably, in operation a gloss test patch is generated by a patch generator which can be an exposure station that records a control patch on the imaging surface which is developed by the development station 5 or the patch generator can be a separate unit 528. Then the test patch is fused and is measured by the substrate sensor 526. The substrate sensor 526 can be a full width array sensor which measures the patch across the entire width of the substrate.

The gloss calibration system includes a lookup table for storing adjustment parameters values for adjusting the gloss output of the fusing member. The adjustment parameters may also take into account particular substrate attributes for example basis weights, textures, coatings of the substrate and sent the appropriate a adjustment value for the particular substrate attribute. The values contained in the lookup table are predetermined through a series of optimization tests for each substrate, i.e., the values producing a particular set points of gloss for a given substrate attribute may be experimentally predetermined. The lookup tables may be embodied by a ROM including substrate attribute information, for example. The memory locations of the ROM are addressed based on the substrate attribute selected. In addition, the gloss calibration system also examines the delta in measured gloss between each fuser system wherein optimally the delta should be zero.

As illustrated in FIG. 4, appearance sensor can also be sensor that monitors the gloss on the fusing member also this sensor can be used equally suited with gloss rolls as described in co-pending applications D/20031867 and D/20031867Q which are hereby incorporated by reference. The sensor is comprised of an emitter and a receiver. While the fusing member is rotating, the sensor slowly scans from one end of the gloss roll to the other end. This could be accomplished during warm-up time. Many types of methods could be employed to transport the sensor from one end of the roll to the other. Alternately, a full width sensor can be used to scan the entire length of the fusing member. As illustrated in FIG. 4, the sensor housing has bearings that are attached to a pair of slide rails. A timing belt that is fixed to the sensor housing and moved via a stepper motor could control the position of the sensor.

When the emitter is activated at an incident angle to the fusing member, some of the light would be reflected to the receiver and some would be dispersed. Applicant has found that the level of dispersion depends on the changing surface characteristics of the fusing member due to heating the fusing member. For example, in a fusing member having a surface layer composed of VITON® and TEFLON®, etc. the reflective properties change while heated and this change can be equated to gloss levels on the substrate being fused. In addition thereto additional materials can be applied to the surface of the roller as an indicator for gloss change. When gloss balancing two or more fusing members, one is looking for a change in the analog signal coming from the receiver. If the output from one fusing member is substantially less than nominal, the temperature of the roll with less gloss can be raised. The amount to raise the temperature by is determined by cross referencing the gloss value from the low gloss roll to the nominal value and then using a lookup table or equation to modify the temperature as determined by the latitude space for that type of fuser.

Figure 5:
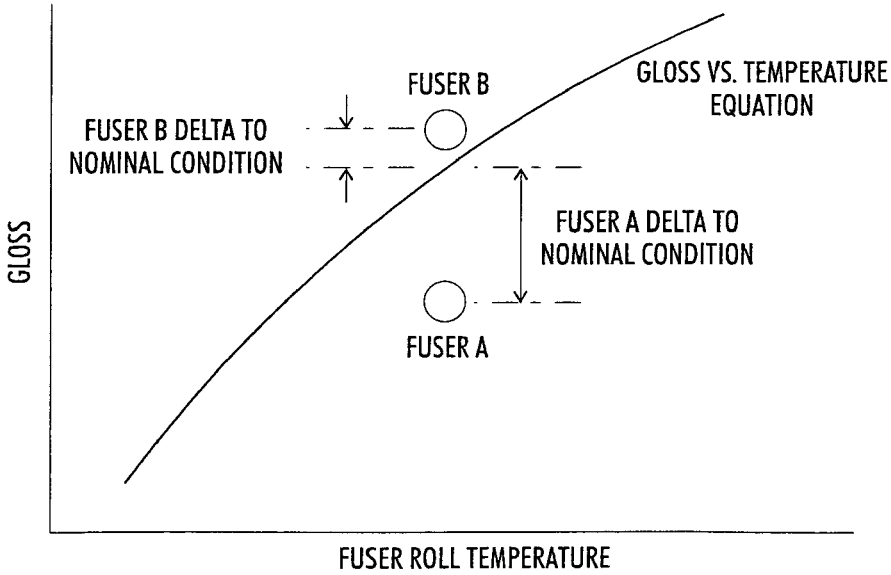
FIG. 5 illustrates an example of data curve which can be used to maintain proper functioning of the present invention.

Referring to FIG. 5, the gloss data shown is a curve that was generated during development and represents the nominal gloss versus temperature curve for the xerographic printing machine as illustrated in FIG. 1. In the tandem printing system configuration (FIG. 2) are two fuser systems, one in each individual marking engine. If one fuser system 7 is performing above the nominal gloss value for the given settings, its temperature can be lowered. Conversely if the other fuser system is determined by the curve itself. If one knows the equation of the curve in the general vicinity one is interested in, then one can also determine its derivative. Once the derivative, (or equation of the slope) is determined, the delta between the fuser systems actual position and the nominal curve can be used in conjunction with the slope to solve for the required temperature change to bring the fuser systems back to the nominal condition. This entire process could be done during warm up. Also the nip pressure can be adjusted between the fusing member 510 and pressure roll 512 to change the gloss value and also the speed in which the substrate moves through the nip.

Also this sensing system can be used to detect defects in the fuser systems. In this case as the sensor observes an area of less reflectivity, the output voltage would be lower, thereby indicating a defect. Once the defect has been identified and located and the defect position mapped, the scheduler is informed of the defect. In the case of a tightly integrated parallel printing machine, where there are multiple individual marking engines and therefore multiple fusers in the same overall machine, if the incoming job has a need for high gloss in the affected area, the scheduler sends the job to another fuser system in the parallel printing machine. A warning is sent to the user or to service that it is time to replace the roll soon.

The calibration system has an optional first mode of operation wherein the calibration system adjust the gloss levels of each fusing system based upon the fuser gloss value on the surface of the fuser member during a warm up routine. The first mode of operation is particularly useful because it gives an indication of the gloss characteristics across the entire fusing member. Also, the calibration system has an optional second mode of operation wherein the calibration system adjust the gloss levels of each fusing system based upon the substrate gloss value of marking particles fused on a surface of the substrate during a printing mode. The second mode of operation is particularly useful because it gives an indication of the gloss characteristics of fusing member in real-time. The calibration system includes a scheduling system for periodically polling the gloss performance of each fuser system by enabling sensing of the fusing member gloss and/or sensing of the gloss on the substrates.

In recapitulation there has been provided a sensor system for detecting gloss levels of a printed image on a substrate generated by a print engine, including a fixing member for fixing marking particles on the substrate, an optical sensor for sensing a gloss value of the surface of the fixing member; and controller for correlating the gloss value of the surface of the fixing member to a gloss value of the printed image on the substrate. In one embodiment, the sensor includes an optical sensor for sensing a fuser gloss value of residue marking particles on a surface of a fuser member.

Other embodiments and modifications of the present invention may occur to those skilled in the art subsequent to a review of the information presented herein; these embodiments and modifications, as well as equivalents thereof, are also included within the scope of this invention.

What is claimed:

1. A printing architecture comprising:

at least a first print engine and a second print engine and transport assemblies which convey substrate outputs of the first and second print engines to a common finisher assembly, the first print engine including a first fuser system having a first fusing member for fusing marking particles on a substrate and the second print engine including a second fuser system having a second fusing member for fusing marking particles on the substrate, the printing architecture having a sensor system, comprising:

a calibration system for maintaining uniform gloss characteristics between printed images generated by the first fusing system and the second fusing system, said calibration system including a sensor for sensing a gloss value indicative of the gloss of the fused marking particles on the substrate outputs of the first and second print engines; and a controller for adjusting the gloss level of said first and second fusing members to maintain a uniform gloss characteristic between said first and second fusing members, the controller adjusting a temperature level of said first and second fusing members in response to the sensed gloss values.

2. The printing architecture of claim 1, further comprising a gloss patch generator for generating a gloss patch on the substrate.

3. The printing architecture of claim 2, wherein said sensor is in communication with said controller and generates a control signal if detected gloss levels on said gloss patch are beyond a predefined target value.

4. The printing architecture of claim 1, wherein said controller includes means for correlating fuser adjustment values to detected gloss level.

5. The printing architecture of claim 4, wherein said correlating means includes a look-up table.

6. The printing architecture of claim 5, wherein said look-up table includes values predetermined based on a given substrate attribute.

7. The printing architecture of claim 1, wherein said sensor is in communication with said controller and generates a control signal if a detected gloss level on said fuser member is beyond a predefined target value.

8. The printing architecture of claim 1, wherein said sensor includes an optical sensor for sensing a fuser gloss value of residue marking particles on a surface of a fuser member.

9. The printing architecture of claim 1, wherein said calibration system includes an optical sensor for sensing a fuser gloss value of residue marking particles on a surface of the fuser member and a sensor for sensing a substrate gloss value of marking particles fused on a surface of the substrate.

10. The printing architecture of claim 1, wherein said calibration system has an optional first mode of operation wherein said calibration system adjusts the gloss levels of said first and second fusing systems based upon the fuser gloss value of residue marking particles on the surface of the fuser member during a warm up routine.

11. The printing architecture of claim 10, wherein said calibration system has an optional second mode of operation wherein said calibration system adjusts the gloss levels of said first and second fusing systems based upon the substrate gloss value of marking particles fused on the surface of the substrate during a printing mode.

12. The printing architecture of claim 1, wherein said calibration system includes a scheduling system for periodically polling the gloss performance of either said first or said second fuser system by enabling at least one of sensing the substrate gloss and sensing the fuser member gloss.

13. The printing architecture of claim 1, wherein said sensor senses a fuser gloss value of a surface of one of said first and second fuser members.

14. A printing architecture comprising:

a first print engine including a first fuser system having a first fusing member for fusing marking particles on a substrate;

a second print engine including a second fuser system having a second fusing member for fusing marking particles on the substrate; and a sensor system, comprising:

a calibration system for maintaining uniform gloss characteristics between printed images generated by the first fusing system and the second fusing system, said calibration system including a sensor for sensing a gloss value of the surface of each fusing member, the calibration system correlating the gloss value of the surface of the fusing member to a gloss level of the printed image on the substrate, and a controller for adjusting an operating temperature of the first and second fusing systems based on the sensed gloss values to maintain a uniform gloss characteristic between said first and second fusing systems.

* * * * *